US007503626B2

(12) United States Patent
Maier et al.

(10) Patent No.: US 7,503,626 B2
(45) Date of Patent: Mar. 17, 2009

(54) CHAIR HAVING A TILTABLE SEAT

(75) Inventors: Klaus Maier, Dachsberg (DE); Kurt Buntru, Stuehlingen (DE); Thomas Stenzel, Waldshut-Tiengen (DE)

(73) Assignee: Sedus Stoll AG, Waldshut-Tiengen (DE)

( * ) Notice: Subject to any disclaimer, the term of this patent is extended or adjusted under 35 U.S.C. 154(b) by 0 days.

(21) Appl. No.: 11/743,346

(22) Filed: May 2, 2007

(65) Prior Publication Data

US 2008/0174161 A1 Jul. 24, 2008

(30) Foreign Application Priority Data

Jan. 22, 2007 (EP) ..... 07001293

(51) Int. Cl.
*A47C 3/026* (2006.01)
*A47C 1/024* (2006.01)
*A47C 1/038* (2006.01)

(52) U.S. Cl. ..... 297/300.2

(58) Field of Classification Search ..... 297/300.2
See application file for complete search history.

(56) References Cited

U.S. PATENT DOCUMENTS 5,333,368 A * 8/1994 Kriener et al. ..... 297/302.1
5,582,459 A * 12/1996 Hama et al. ..... 297/300.2
5,664,834 A * 9/1997 Hsu ..... 297/300.1
5,810,439 A * 9/1998 Roslund, Jr. ..... 297/300.2 X
6,120,096 A * 9/2000 Miotto ..... 297/300.2 X
6,523,897 B2 * 2/2003 Pan ..... 297/300.2 X
6,588,843 B1 * 7/2003 Ebenstein ..... 297/300.2 X
6,588,844 B1 * 7/2003 Stenzel ..... 297/300.2
6,644,741 B2 * 11/2003 Nelson et al. ..... 297/300.2 X
6,840,578 B1 * 1/2005 Su ..... 297/300.2 X
6,945,602 B2 * 9/2005 Fookes et al. ..... 297/300.2 X
7,147,285 B2 * 12/2006 Lin ..... 297/300.2 X

FOREIGN PATENT DOCUMENTS

EP 1 192 876 A2 4/2002
EP 1 576 905 A1 9/2005

* cited by examiner

*Primary Examiner*—Rodney B. Whhite
(74) *Attorney, Agent, or Firm*—Oblon, Spivak, McClelland, Maier & Neustadt, P.C.

(57) ABSTRACT

A chair is provided which has a tiltable seat carrier and a tiltable backrest on the backrest carrier which are forcibly coupled to one another, and which has an individual adjustment feature for the tilt of the seat carrier in relation to the backrest carrier. Provided on the underside of the seat carrier is a bearing block having a slideway contour and a vertical slot in which the flange of a lifting element is mounted vertically movably, wherein the lifting element has a substantially triangular collar which slides on the substantially rectangular slideway contour when the flange moves vertically. The tilt of the seat carrier can be adjusted to be steeper or flatter by turning the lifting element, and the limit positions are completely stable such that the possibility of automatic unlocking is eliminated.

6 Claims, 5 Drawing Sheets

CHAIR HAVING A TILTABLE SEAT

FIELD OF THE INVENTION

The invention relates to a chair having a tiltable seat and a tiltable backrest supported by a backrest carrier. Chairs of this kind are important not just in the office sector, where it has to be possible for the user to adapt the chair to his respective working position from an ergonomic point of view, but also in private life, where the user would like to alter the respective tilt of the seat and backrest for the purposes of relaxation.

PRIOR ART

Chairs having a tiltable seat and a tiltable backrest are known for example from EP-A 0834271, EP-B 0489961 or EP-B 0233974. The chairs known from these publications have tiltable seats and backrests, with the seat and the backrest being forcibly coupled to one another. This is therefore called a synchronous mechanism.

These chairs have proved extremely successful in practice. However, they are not yet ideal, since the user must still use the tilt relationship between the seat and the backrest which is predetermined by the synchronous mechanism. It is not possible for the user to adjust the backrest tilt in a particular position and to alter the tilt of the seat in such a position.

A chair has therefore been developed which is described in EP-A 1192876 and which is provided on the underside of the seat with a bearing block in which there is rotatably mounted a disc through which a hexagonal rod with a handle passes in an eccentric arrangement, the handle being mounted in an arm on the backrest carrier. This known design has proved successful. However, it has the disadvantage that when the tilt of the seat is being adjusted, the seat has to perform a horizontal movement, which is undesirable from a design point of view because it restricts the freedom of design of the mounting of the seat, in particular at the front edge.

The known design has therefore been further developed as described in EP-A 1576905: the basic concept of the further development consists in the idea that, while the seat is being supported on the backrest carrier, it should be possible for the spacing between the seat and the backrest carrier to be altered by hand in rectilinear manner by means of a special bearing. This means that in principle, the seat follows the tilt of the backrest, but in addition, its tilt can still be adjusted individually without performing a horizontal movement. For this purpose, the design of the bearing block on the underside of the seat has a vertical slot and a slideway contour, the flange of the lifting element being guided in the slot and the collar of the lifting element sliding on the slideway contour when the flange is moved.

However, this solution is not yet ideal either, since it does not give maximum stability in the event of severe loading or unloading.

The invention is intended to remedy this.

SUMMARY OF THE INVENTION

The object of the invention is accordingly further to improve a chair having a tiltable seat and a tiltable backrest, in which the tilt of the seat can be adjusted individually, independently of the tilt provided by a synchronous mechanism in dependence on the tilt of the backrest, such that the seat has maximum stability. In this case, the design according to the invention must be of little complexity and it must be possible to manufacture it easily in the production process, and it must moreover be fully satisfactory from a visual and aesthetic point of view.

This object is achieved by the features of Claim 1 and the subclaims.

BRIEF DESCRIPTION OF THE DRAWINGS

The invention will be explained in more detail below with reference to an exemplary embodiment which is illustrated in drawings, in which.

WAYS OF IMPLEMENTING THE INVENTION

Figure 1:
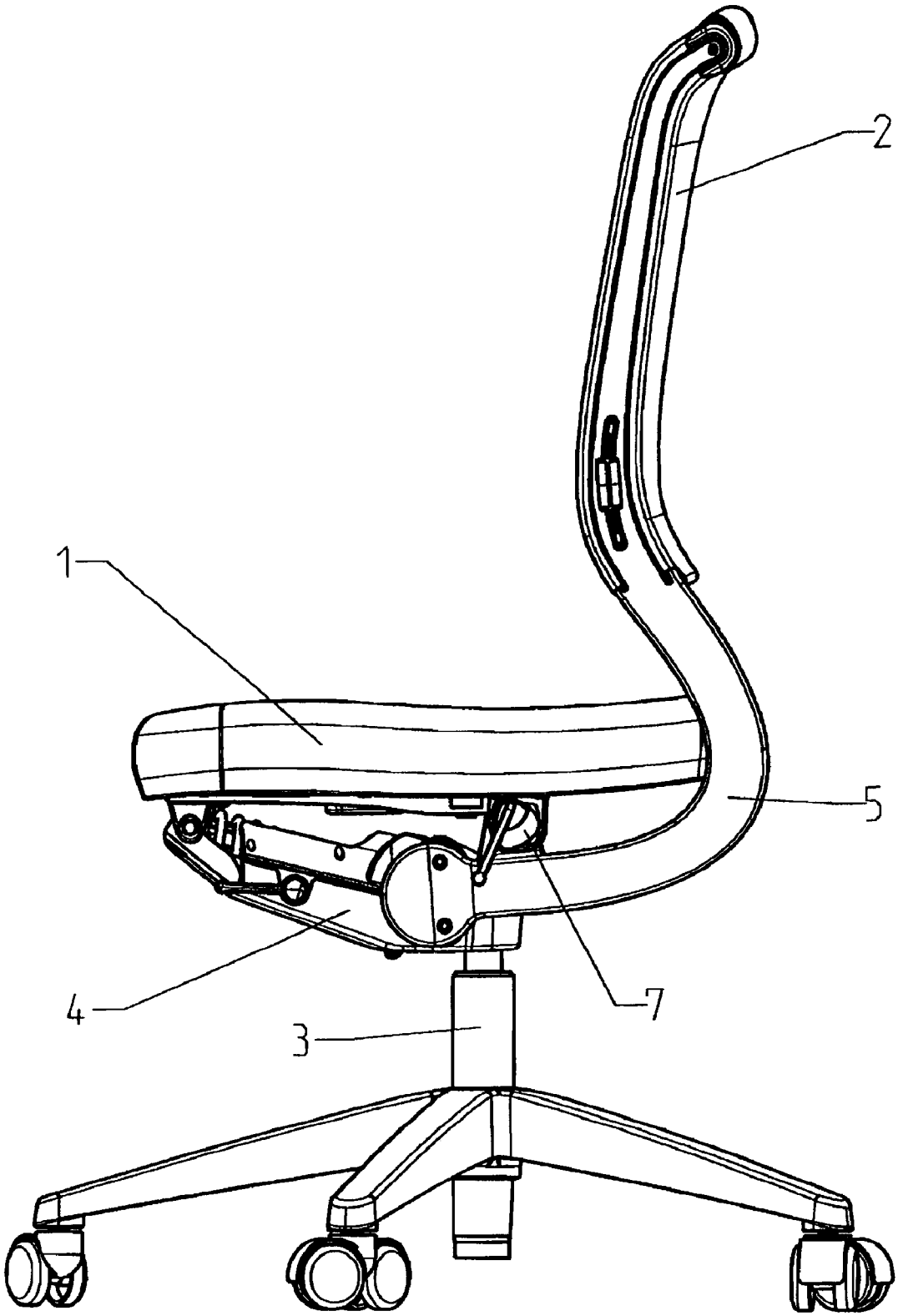
FIG. 1 shows a side view of a chair according to the invention with the seat lowered.
Figure 2:
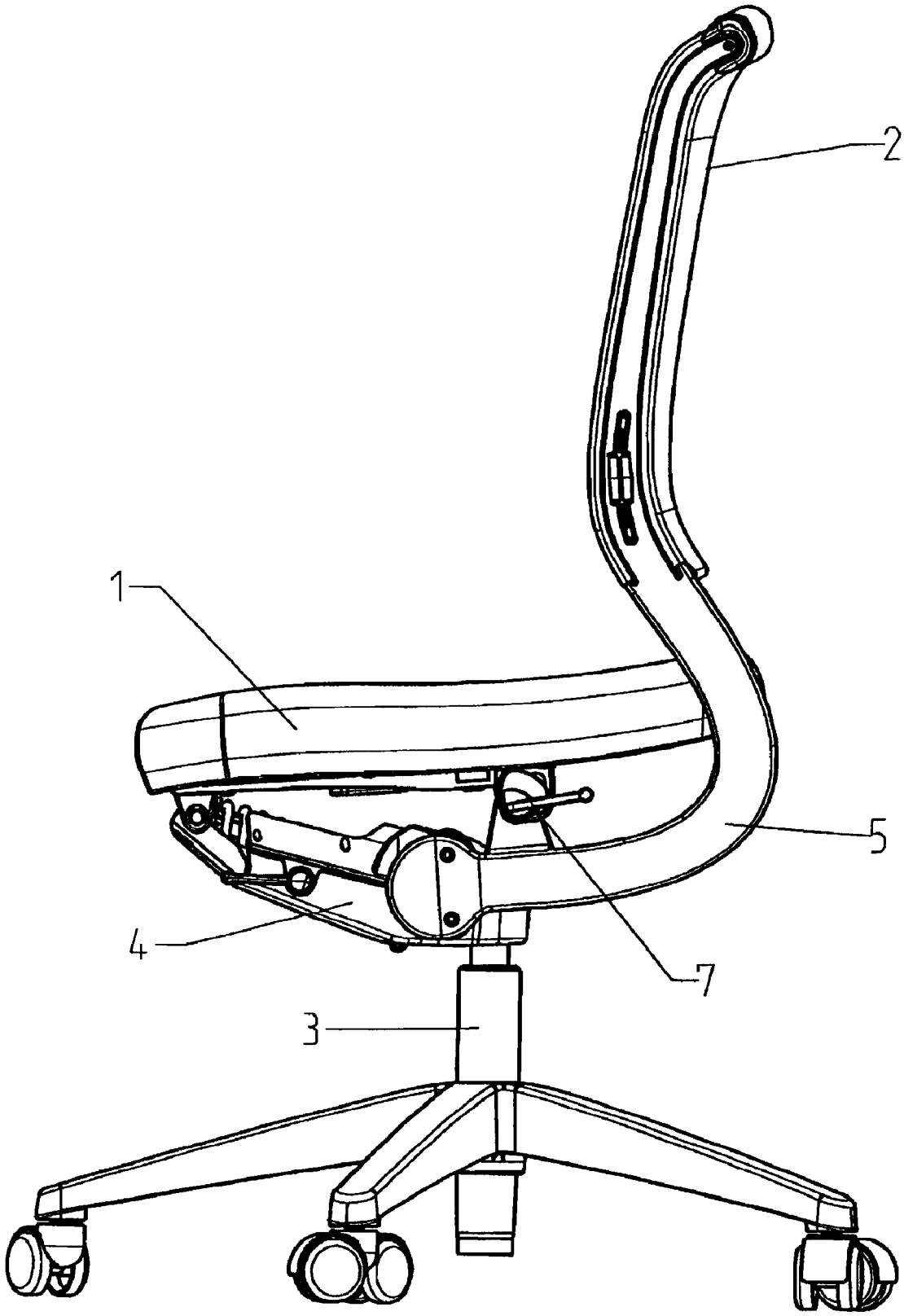
FIG. 2 shows a view like that in FIG. 1, but with the seat raised.

The main components of the chair shown in FIG. 1 and FIG. 2 are the seat with the seat carrier 1, the backrest 2 with backrest carrier 5, the tilting mechanism casing 4, and the base column 3.

The seat and the backrest carrier 5 with backrest 2 are forcibly coupled to one another, in terms of their tilt, in known manner by way of the tilting mechanism and the articulated link between the seat carrier and the backrest carrier 5. Thus, if the backrest 2 and with it the backrest carrier 5 are tilted backwards, the seat carrier 1 is also lowered.

Figure 3:
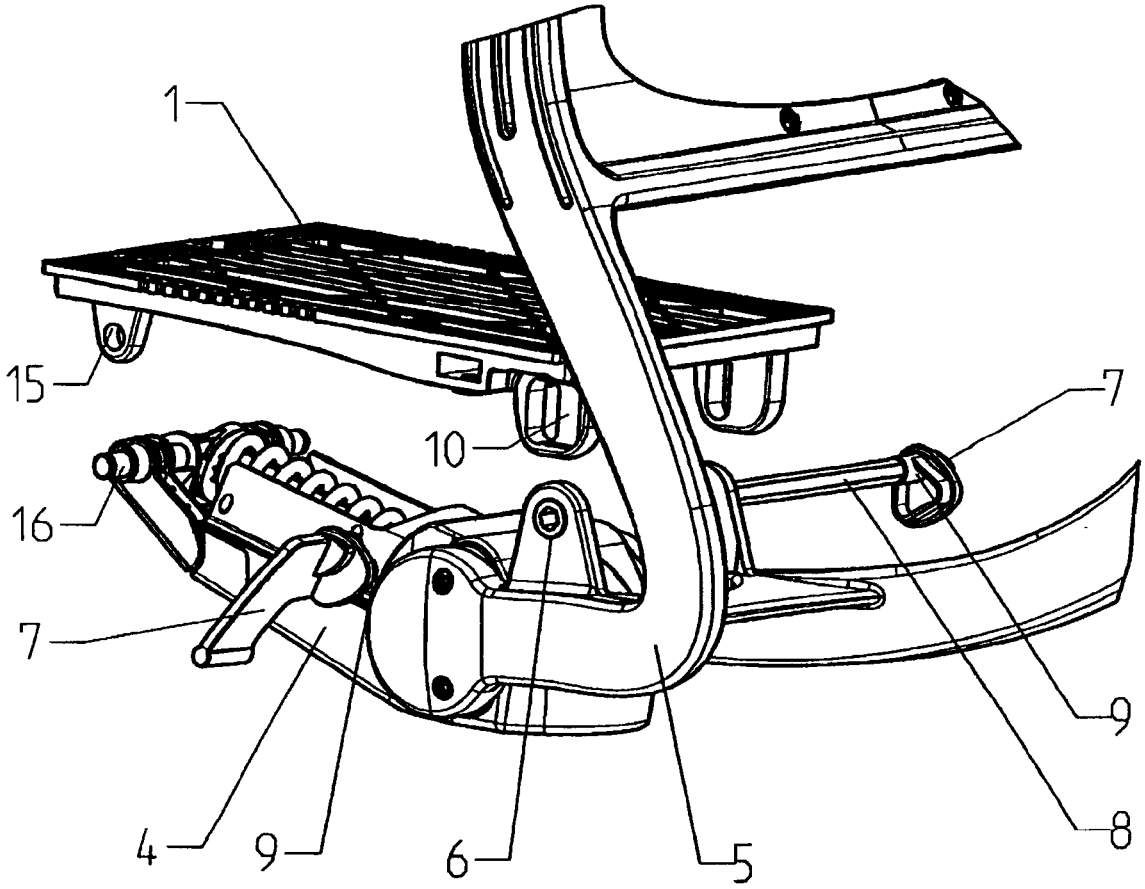
FIG. 3 shows a perspective exploded view of the seat carrier, the backrest carrier, the tilting mechanism casing and the bearing according to the invention, FIG. 4 also shows a perspective exploded view of the bearing according to the invention, but from a different direction of view, without the tilting mechanism casing.
Figure 4:
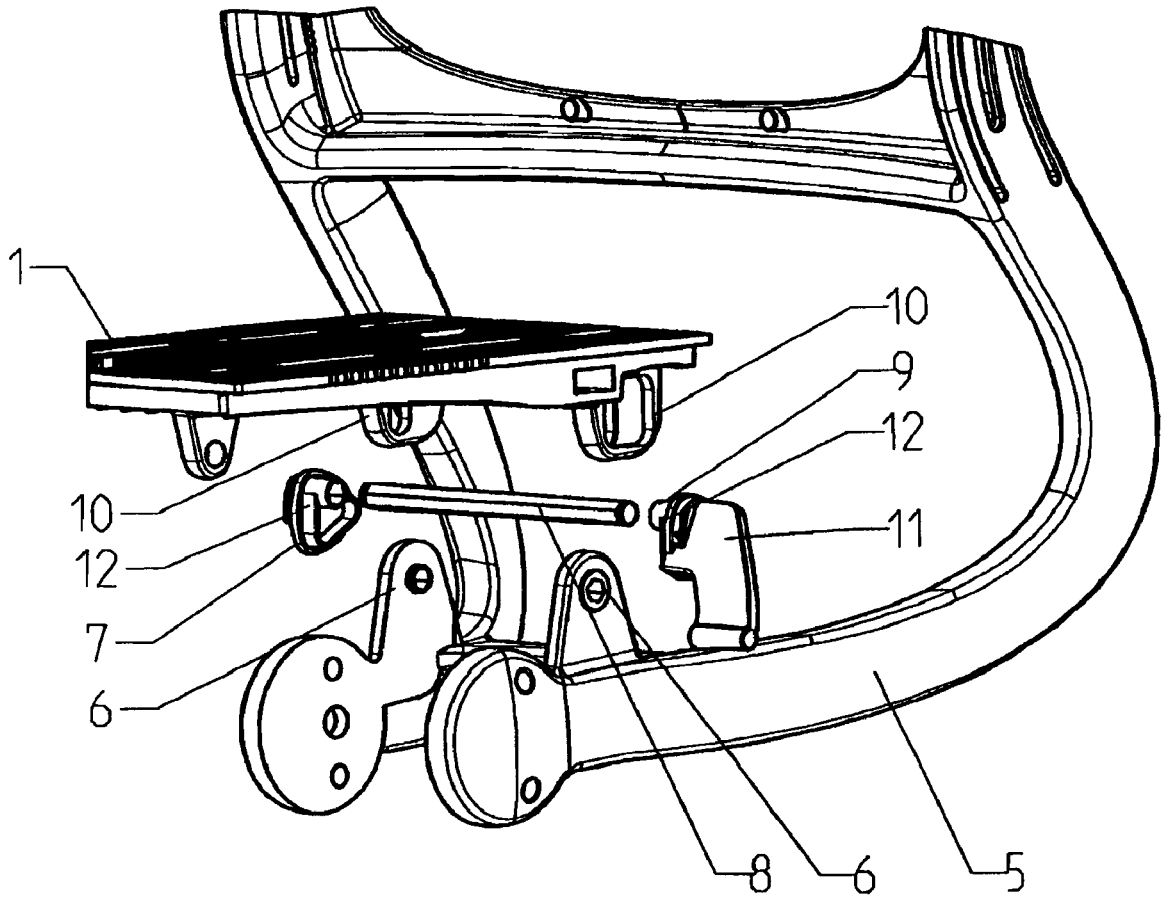
Figure 5:
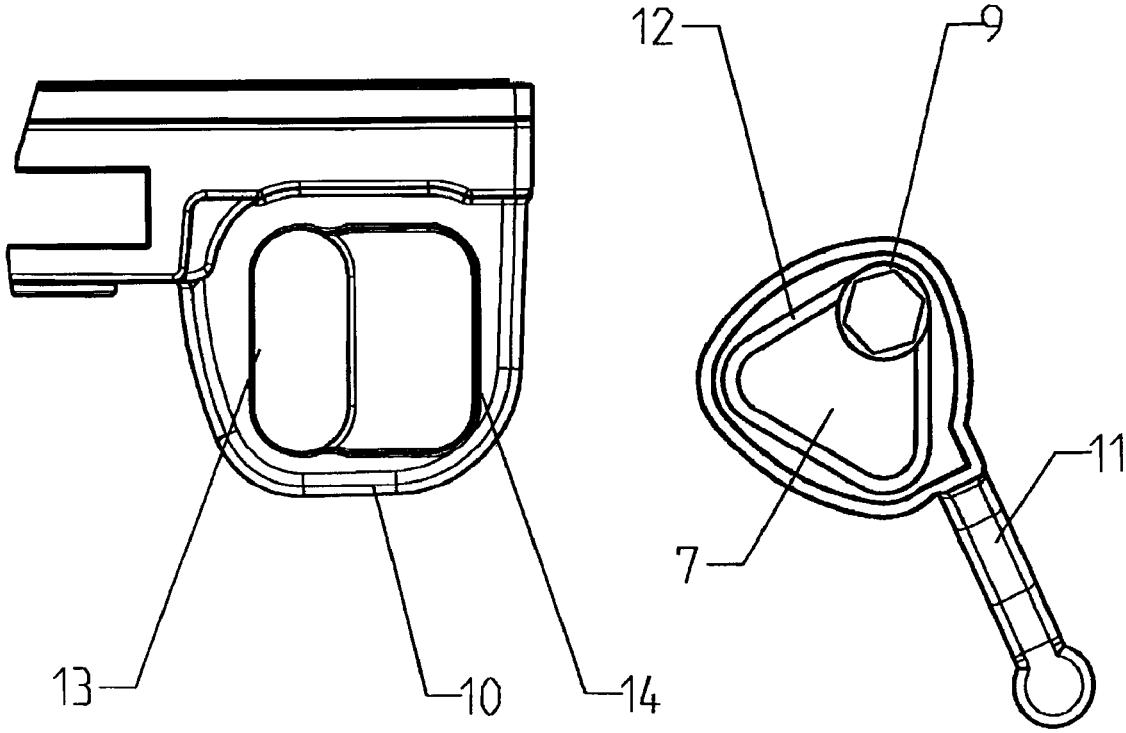
FIG. 5 shows a side view of the bearing block and the lifting element, with the outside of the bearing block and the inside of the lifting element being shown.

However, the articulated link between the seat carrier 1 and the backrest carrier 5 comprises, in accordance with the invention, the elements 7-14, which are shown in detail in FIGS. 3, 4 and FIG. 5.

Provided on the underside of the seat carrier 1, to the left and right respectively, is a bearing block 10 which has a slot 13 and a slideway contour 14. Bearings 6 are respectively provided to the left and right on the backrest carrier 5. Furthermore, the rod 8, taking the form of a hexagon, is provided and the lifting element 7 is pushed onto each of its two ends by means of the flange 9. Because the flange 9 also takes the form of a hexagon, the lifting element 7 is seated on the rod 8 in such a way that it cannot rotate. In the fully mounted state, the rod 8 passes successively through the first bearing block 10, the first bearing 6, the second bearing 6, and then the second bearing block 10. The flange 9 of the lifting element 7 is in each case guided vertically movably in the respective slots 13 of the bearing blocks 10, and the collar 12 is movable within the slideway contour 14.

So that the lifting element 7 can be operated by the person using the chair, it has the handle 11.

As can be seen in particular from FIG. 5, the lifting element 7 furthermore has the collar 12, which comprises a peripheral web substantially having the shape of an equilateral triangle with rounded corners, in one corner of which the flange 9 is seated. The bearing block 10 has the slot 13 and the slideway contour 14 in a manner corresponding to this. The slideway contour 14 has approximately the shape of a rectangle with rounded corners, one side of which runs parallel to the slot 13 and the other side of which runs horizontally above the slot 13. For the purpose of mounting, the lifting element 7 is introduced with the flange 9 into the slot 13, the collar 12 coming to lie inside the slideway contour 14.

Mounting of the seat carrier 1 on the front edge is effected by way of the seat bearings 15 on the seat bearing pin 16.

In operation, the mechanism according to the invention works as follows.

When the rear edge of the seat carrier 1 is lowered, as illustrated in FIG. 1, the flange 9 of the lifting element 7 is located in the upper position in the slot 13. The front side of the collar 12 runs parallel to the slot 13 and lies with its lower rounded corner in the lower rounded corner of the slideway contour 14. The handle 11 is in a vertical position, as shown in FIG. 5.

If the rear edge of the seat carrier 1 is now to be raised in relation to the backrest carrier 5, as shown in FIG. 2, the lifting element 7 is turned anti-clockwise to the rear, by means of the handle 11. This moves the lower rounded corner of the collar 12 to the lower rear rounded corner of the slideway contour 14, where it latches in and defines the latching point thereof. On further movement, this upper position is locked so that automatic adjustment of the mechanism can no longer take place.

To lower the rear edge of the seat carrier 1, the handle 11 is then returned to its vertical position. This means that the collar 12 is supported by means of its rounded corners on the slideway contour 14 again, and the flange 9 is subjected to an upwardly directed force. This is additionally aided by the weight of the person using the chair acting on the bearing block 10. In the limit position, the lifting element 7 is then once again in the position shown in FIG. 5.

Because the lifting element 7 and the bearing block 10 have to transmit considerable forces, they are made of glass-fibre reinforced polyamide. The rod is made of steel.

It can be seen that the invention achieves the advantages sought according to the object to a high degree: the two limit positions of the height adjustment are completely stable and the possibility of automatic unlocking is ruled out.

LIST OF REFERENCE NUMERALS

1 Seat carrier
2 Backrest
3 Base column
4 Tilting mechanism casing
5 Backrest carrier
6 Bearing
7 Lifting element
8 Rod
9 Flange
10 Bearing block
11 Handle
12 Collar
13 Slot
14 Slideway contour
15 Front seat bearing
16 Seat bearing pin

The invention claimed is:

1. A chair comprising:

a tiltable seat carrier and a tiltable backrest supported by a backrest carrier, the backrest carrier including a bearing positioned thereon, an underside of the seat carrier including a bearing block in which a rod having a lifting element is vertically movably mounted, the rod also being mounted at one end thereof in said bearing on the backrest carrier, the bearing block having a vertical slot formed therein and a slideway contour, and a flange located on the backrest carrier, the lifting element being connected to the rod by said flange, said flange being vertically movably mounted in the slot, and having a collar connected thereto, the slideway contour of said bearing block having a rectangular shape with a plurality of straight sides which are connected to one another by first rounded corners, a first side of the slideway running parallel to the slot and a second side thereof running horizontally above the slot, and the collar having an equilateral triangular shape with three straight sides which are connected to one another by second rounded corners, the flange being seated in a corner portion of the collar and said corner portion of the collar being positioned at a front upper corner of the slideway contour when the flange is in an upper position and being positioned at a front lower corner of the slideway contour when the flange is in a lower position, wherein the front upper corner and front lower corner of the collar are respectively supported on the slideway contour upon upward and downward movement of the flange.

2. A chair according to claim 1, wherein the rod and the flange have a prismatic surface, and wherein the lifting element is connected to the rod and is rotatable with the rod upon rotation of said lifting element.

3. A chair according to claim 2, wherein the prismatic surface has a hexagonal surface.

4. A chair according to claim 1, wherein the collar comprises a peripheral web having rounded parts, the web being supported on the slideway contour by the rounded parts of the peripheral web.

5. A chair according to claim 4, wherein the lifting element includes a handle and wherein, when the flange is in an upper position, the handle of the lifting element is in a vertical position.

6. A chair according to claim 1, wherein the rod comprises a steel rod and the bearing block and the lifting element are made of glass-fiber reinforced polyamide.

* * * * *